US005156779A

United States Patent [19]

McGowan

[11] Patent Number: 5,156,779

[45] Date of Patent: * Oct. 20, 1992

[54] PROCESS AND APPARATUS FOR PRODUCING ULTRAFINE EXPLOSIVE PARTICLES

[75] Inventor: Michael J. McGowan, Martinsburg, W. Va.

[73] Assignee: E. I. Du Pont de Nemours and Company, Wilmington, Del.

[ * ] Notice: The portion of the term of this patent subsequent to Aug. 20, 2007 has been disclaimed.

[21] Appl. No.: 345,360

[22] Filed: Apr. 27, 1989

[51] Int. Cl.[5] ..... C06B 21/00

[52] U.S. Cl. ..... 264/3.3; 269/3.4; 422/163; 149/21; 149/109.6

[58] Field of Search ..... 264/3.3, 3.4; 422/163; 149/21, 109.6

[56] References Cited

U.S. PATENT DOCUMENTS

| | | | |
|---|---|---|---|
| 4,444,606 | 4/1984 | Bertrand et al. | 264/3.3 X |
| 4,685,375 | 8/1987 | Ross et al. | 264/3.4 X |
| 4,767,577 | 8/1988 | Muller | 264/3.3 X |
| 4,801,413 | 1/1989 | Wagner et al. | 264/3.3 X |

*Primary Examiner*—Peter A. Nelson

[57] ABSTRACT

A method and an improved eductor apparatus for producing ultrafine explosive particles is disclosed. The explosive particles, which when incorporated into a binder system, have the ability to propagate in thin sheets, and have very low impact sensitivity and very high propagation sensitivity. A stream of a solution of the explosive dissolved in a solvent is thoroughly mixed with a stream of an inert nonsolvent by obtaining nonlaminar flow of the streams by applying pressure against the flow of the nonsolvent stream, to thereby diverge the stream as it contacts the explosive solution, and violently agitating the combined stream to rapidly precipitate the explosive particles from the solution in the form of generally spheroidal, ultrafine particles. The two streams are injected coaxially through continuous, concentric orifices of a nozzle into a mixing chamber. Preferably, the nonsolvent stream is injected centrally of the explosive solution stream. The explosive solution stream is injected downstream of and surrounds the nonsolvent solution stream for a substantial distance prior to being ejected into the mixing chamber.

16 Claims, 3 Drawing Sheets

PROCESS AND APPARATUS FOR PRODUCING ULTRAFINE EXPLOSIVE PARTICLES

The government of the United States of America has rights in this invention pursuant to DOE Contract No. DE-ACO4-87AL42544, Subcontract LCRL-89913 subject to advance waiver of patent rights W(A) 87-005.

BACKGROUND OF THE INVENTION

The present invention is directed to a process and apparatus for producing ultrafine explosive particles, and more particularly to an improved eductor device that produces ultrafine granular explosives which when incorporated into a binder system have the ability to propagate in thin sheets and have very low impact and very high propagation sensitivities.

Normally crystalline high explosives have been treated by various techniques to reduce their particle size. The particular particle size of explosives has a pronounced effect on its performance, and, generally the smaller the particles, the more sensitive the explosive is to reliable propagation sensitivity. Heretofore particles of high explosive have been prepared by dissolving the explosive in a solvent that is inert to the explosive and mixing the solvent with a liquid that is a nonsolvent for the explosive and is miscible with the solvent, or drowning the solution of explosive in the nonsolvent precipitating agent. Further, various modifications of these processes are known wherein, for example, additional nonsolvent is added to the turbulent mixture in order to produce fine crystals of high explosive, as described, for example, in British Patent No. 988,122, published Apr. 7, 1965. Such procedures have employed eductors or jet nozzles, as illustrated in Canadian Patent No. 533,487, for mixing one stream containing explosive dissolved in solvent and the other stream containing the nonsolvent precipitating agent. Such procedures produce small particles of high explosive, but the finely-divided explosives made by such methods do not consistently propagate detonations and are unreliable and erratic, especially when used in compositions wherein the particulate explosive is incorporated in a binder and the final product is formed into thin sheets or small diameter explosive cords. Therefore, a need exists for high explosives that can be used in such thin sheets or small diameter cords which consistently propagate detonation and exhibit a high order of propagation sensitivity and a low order of impact sensitivity.

The prior art discloses various processes and apparatus for making spheroidal ultrafine explosive particles. For example, see U.S. Pat. No. 2,329,575; 1,106,087; 2,715,574 and 3,754,061. More specifically, U.S. Pat. 3,754,061 discloses manufacturing crystalline high explosives into finely-divided spheroidal particles by mixing individual streams of a explosive solution with an inert nonsolvent solution by applying pressure against the flow of the nonsolvent stream, violently agitating the combined stream, and rapidly precipitating the explosive from the solution in the form of spheroidal particles permeated with microholes. The reference discloses injecting the two solutions at right angles to each other. However, this system has been found to be insufficient in that relatively large explosive particles precipitate in the area adjacent the nozzle in "dead spots". This necessarily reduces the area of explosive solution flow to a fraction of the theoretical value, and therefore adversly impacts the efficiency of the eductor since the explosive solution flow is channeled into only a portion of the nonsolvent stream thereby leading to relatively large particle size distribution. The large explosive particles which build up inside the eductor become dislodged when the eductor is under shut-down conditions and become blended with the desirable process stream during operating conditions. The result is that the final formulation contains a large quantity of relatively large explosive particles which add to the undesirable sensitivity of the explosive formulation to detonation by impact from, for example, a falling weight.

OBJECTS AND SUMMARY OF THE INVENTION

In accordance with the above, the principal object of the present invention is to provide an improved eductor device which eliminates the disadvantages associated with conventional eductors.

Another object of the present invention is to provide an improved eductor which produces ultrafine granular explosive particles exhibiting very low impact sensitivity and very high propagation sensitivity.

Yet another object of the present invention is to provide an improved eductor which produces ultrafine granular explosive particles which when incorporated into a binder system have the ability to propagate in thin sheets.

An additional object of the present invention is to provide an improved eductor which substantially improves mixing of the explosive solution with the inert nonsolvent solution to thereby bring about faster precipitation of the explosive particles and produces ultrafine particles size for a given explosive solution nonsolvent flow ratio.

A further object of the present invention is to provide a method of producing ultrafine explosive particles which when incorporated into a binder system have the ability to propagate in thin sheets and have very low impact sensivity and high propagation sensitivity.

The objects of the present invention are accomplished by an improved method and apparatus which provide finely-divided normally crystalline high explosives that will consistently propagate detonation when the explosive is incorporated in a binder and the final product is formed into thin sheets of, for example, thickness of 0.025 inch and small diameter, e.g., about a millimeter, detonating cord. The normally crystalline high explosive is converted into finely-divided generally spheroidal particles. The process for making such explosive comprises mixing separate streams of a solution of the explosive dissolved in an inert solvent and of an inert nonsolvent miscible with the solvent in a manner so as to obtain nonlaminar flow of the streams, preferably by applying pressure against the flow of the nonsolvent stream so as to diverge the stream as it contacts the solution of explosive in solvent to entrap the solution of explosive in solvent in minute droplets in the nonsolvent, violently agitating the resulting combined stream so as to subsequently rapidly precipitate the explosive from solution in the form of spheroidal particles. It is critical to the successful operation of the process that the stream of explosive dissolved in inert solvent and the stream of inert nonsolvent are intimately mixed so that laminar flow of the streams does not occur. Nonlaminar flow of the streams coupled with violent agitation of the combined stream so as to obtain rapid precipitation of the explosive is necessary to obtain particles of explosive that are generally spheroidal and that may have microholes throughout.

The mixing of the explosive dissolved in the inert solvent and inert nonsolvent is usually conducted in a confined mixing chamber. Conveniently, the process can be conducted in a modified eductor so as to provide nonlaminar flow of the streams together with violent agitation of the combined stream resulting in rapid precipitation of the explosive. Pressures of about from 1 to 30 pounds per square inch gauge, usually 2 to 6 pounds per square inch gauge, are applied against the flow of the nonsolvent stream to assure conditions that result in nonlaminar flow of the streams. Accordingly, the apparatus discharges against a pressure. Such pressure causes the nonsolvent stream to diverge or disperse, that is fan out, substantially instantaneously as it enters the mixing chamber and contacts the solution of explosive in solvent, thus causing rapid and intimate mixing of the streams. Conveniently, the nonsolvent stream is pumped at pressures of about from 40 to 500, usually 80 to 150, pounds per square inch gauge. Precipitation of the explosive from the time it is contacted with nonsolvent is rapid. Generally, the solution of explosive and nonexplosive are mixed for about one-half millisecond and no more than about 6 milliseconds at which time substantially complete precipitation has occurred. Rapid precipitation is necessary to obtain explosives in which all particles are generally spheroidal that may be permeated with microholes.

The process of the present invention results in a novel high explosive that has low impact sensitivity and is highly sensitive and propagates detonations when the explosive is incorporated in a binder and formed into thin sheets or very small diameter explosive cord or other geometric shapes. The novel explosives include pentaerythritol tetranitrate, cyclotrimethylene trinitramine, trinitrotoluene and cyclotetramethylene tetranitramine. These finely-divided high explosives can be characterized as consisting essentially of spheroidal particles, the particles consisting of agglomerated crystallites of the explosive.

BRIEF DESCRIPTION OF THE DRAWINGS

The above and other objects and advantages and novel features of the present invention will become apparent from the following detailed description and preferred embodiment of the present invention illustrated in the accompanying drawings, in which.

DETAILED DESCRIPTION OF THE INVENTION

Figure 1:
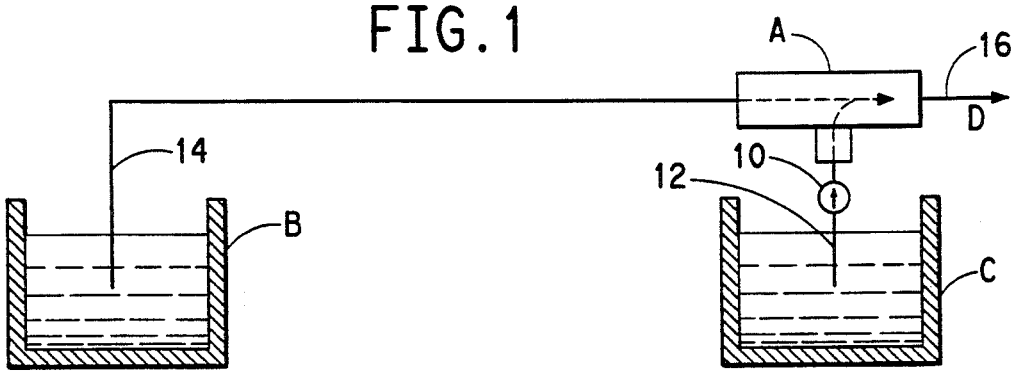
FIG. 1 illustrates a schematic diagram for carrying out the invention.

As shown in FIG. 1, which illustrates a schematic diagram for carrying out the invention, A designates the improved eductor of the present invention. B and C represent reservoirs for the solutions of a crystalizable high e .plosive and the nonsolvent for the explosive composition, respectively. A pump assembly 10 including control valves to regulate the pressure and flow of the nonsolvent is provided between eductor A and reservoir C. Inlet tubes 12 and 14 transport nonsolvent and explosive solutions from reservoirs B and C, respectively, to eductor A. The eductor A discharges the effluent via transport means 16, indicated by arrow D, to a recovery zone (not shown) where the solid, ultrafine, spheroidal particles of explosives are separated by conventional means (not shown), for example, filtration, from the liquid, the liquid portion being transported to a solventnonsolvent separating zone for possible reuse in the process.

Figure 2:
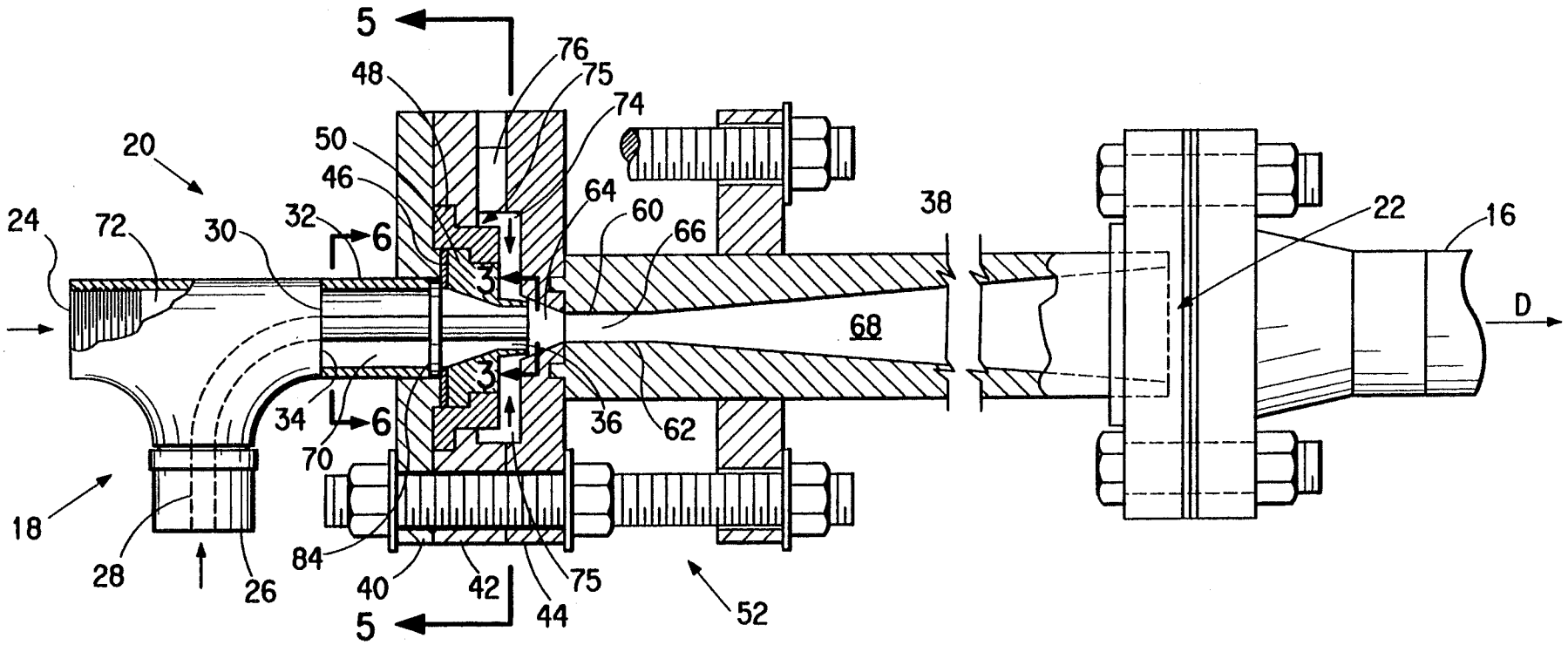
FIG. 2 is a cross-sectional view of the eductor apparatus of the present invention showing only the relevant parts for an understanding of the invention.

Referring now to FIG. 2, the eductor A is in fluid communication with a three-way tap 18 at end 20 thereof and is connected to a conventional explosive particle collection means (not shown) at another end 22 of eductor A. Ports 24 and 26 of three-way tap 18 are respectively connected to reservoirs B and C by conventional conduit means (not shown) for injecting the explosive and nonsolvent solutions, shown by arrows E and F. Numeral 28 represents a piping for supplying the nonsolvent solution to eductor A. The downstream port 30 of three-way tap 18 is connected to spray nozzle assembly 32 at one end 34 thereof. The other end 36 of spray nozzle assembly 32 is in fluid communication with a reactor assembly 38.

As shown in FIG. 2, conventional mounting devices, such as inlet flanges 40, 42, mounting flange 44 have been used to complete the eductor assembly. Reference numeral 46 designates a TEFLON ® PTFE (registered trademark of E. I. du Pont de Nemours and Company) gasket disposed generally between inlet flanges 40 and 42, and numeral 48 represents a conventional seat disposed between inlet flange 42 and nozzle insert 50. Reference numeral 52 represents a conventional nut and bolt assembly for fastening together spray nozzle assembly 32, inlet flanges 40 and 42, mounting flange 44, TEFLON ® gasket 46, seat 48, nozzle insert 50 and reactor assembly 38. (It should be noted that only parts necessary for an understanding of the invention and having relevance thereto are described herein.)

Figure 3:
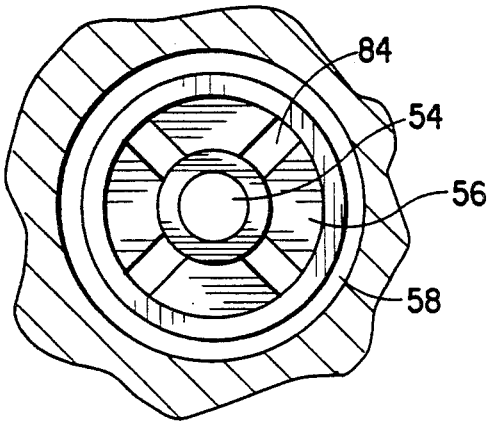
FIG. 3 is an enlarged cross-section taken along line 3—3 of FIG. 2.
Figure 4:
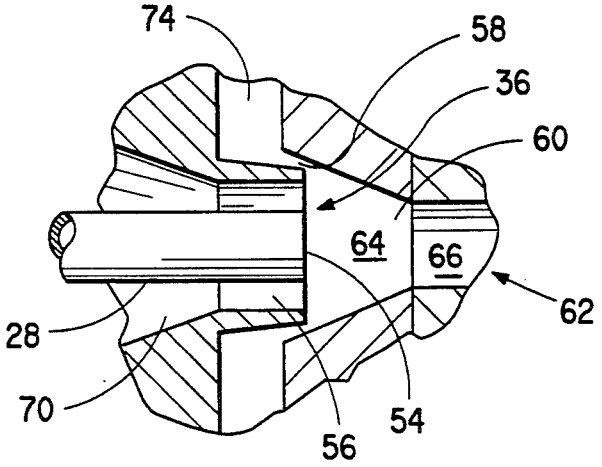
FIG. 4 is a partial enlarged view of the nozzle portion lying adjacent line 3—3 in FIG. 2.

Spray nozzle assembly 32 includes three concentric, continuous orifices 54, 56 and 58, shown in FIG. 3, at end 36 thereof, which end projects into venturi 60 formed in mounting flange 44 and reactor assembly 38. Venturi 60 defines, in succession, mixing chamber 62 including a convergence zone 64, and low pressure throat zone 66, followed by a diffuser 68.

Orifice 54 is positioned along a central axis of nozzle assembly 32 and is in fluid communication with piping 28 for injecting the nonsolvent solution into mixing chamber 62. Similarly, orifice 56, which preferably has a diameter twice that of the diameter of orifice 54, is in fluid communication with passage 70 of nozzle assembly 32. Passage 70 on the other hand, is in fluid communication with passage 72 of three-way tap 18 leading to the source of the explosive solution B. Passages 70 and 72 surround piping 28 with the effect that the explosive solution and the nonsolvent solution flowing therein travel to a considerable distance in generally parallel relationship prior to being ejected from respective recesses 56 and 54.

Figure 5:
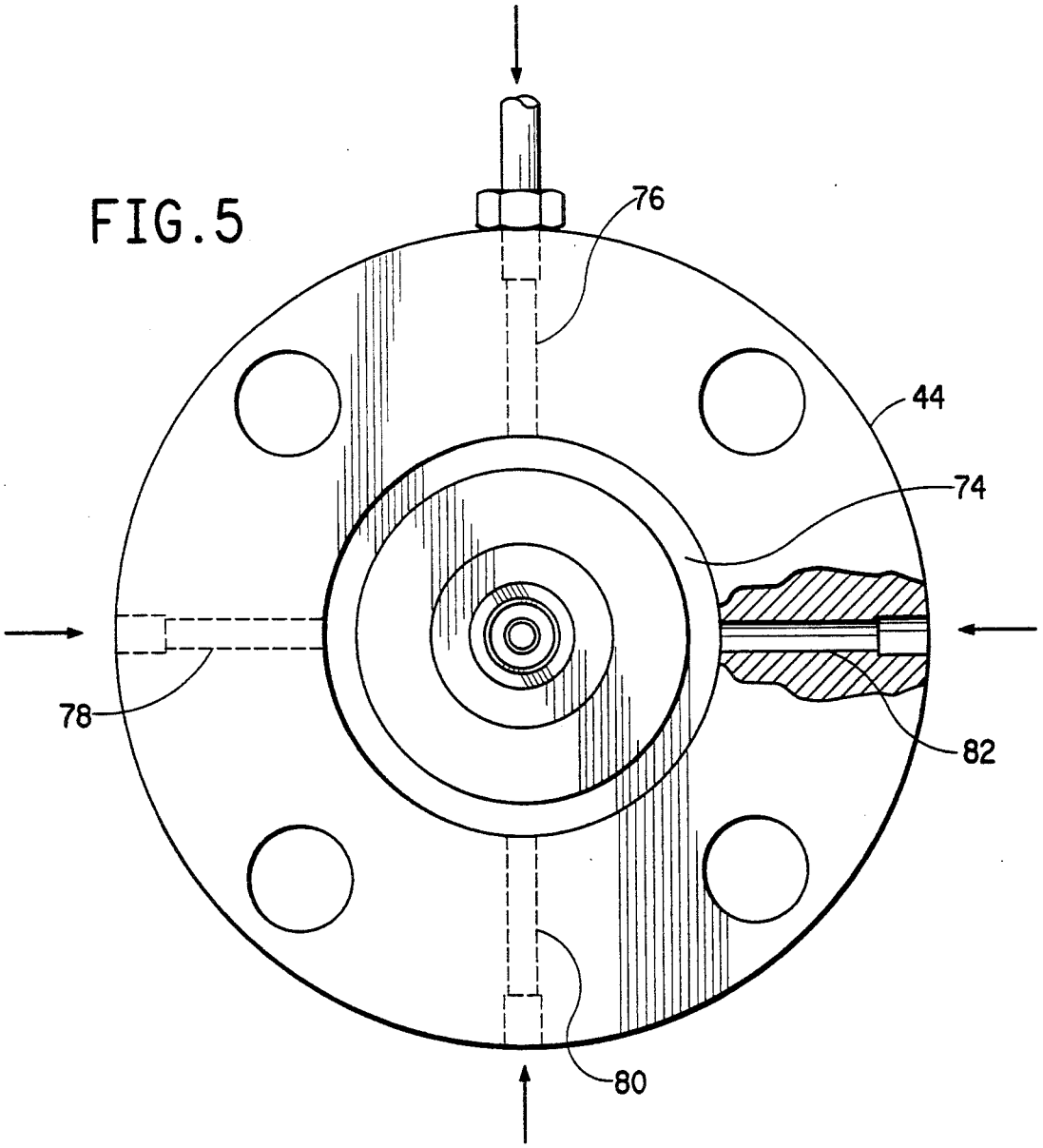
FIG. 5 is an enlarged cross-section taken along line 5—5 of FIG. 2.

Orifice 58, which preferably surrounds orifices 54 and 56, is in fluid communication with a generally circular common zone 74 provided between mounting flange 44 and a common surface 75 defined by inlet flange 42, seat 48 and nozzle insert 50. As best shown in FIG. 5, common zone 74 is fed by preferably four radially extending inlet channels 76, 78, 80 and 82, which are connected to an auxiliary source (not shown) of the nonsolvent solution. Preferably, the diameter of orifice 54 is about twofifths the diameter of orifice 58.

It should be noted that although the nonsolvent solution is injected centrally into mixing chamber 62 through orifice 54 positioned coaxially within orifice 56, it is well within the scope of the invention to reverse the order such that the explosive solution is injected centrally through orifice 54 and the nonsolvent solution is injected through orifice 56. Similarly, the use of auxiliary source for injecting the nonsolvent solution through orifice 58 is optional. In this regard, it should further be apparent to those of ordinary skill in the art that the relative dimensions of orifices 54, 56 and 58, may be varied to obtain optimum mixing of the explosive and the nonsolvent solution.

Figure 6:
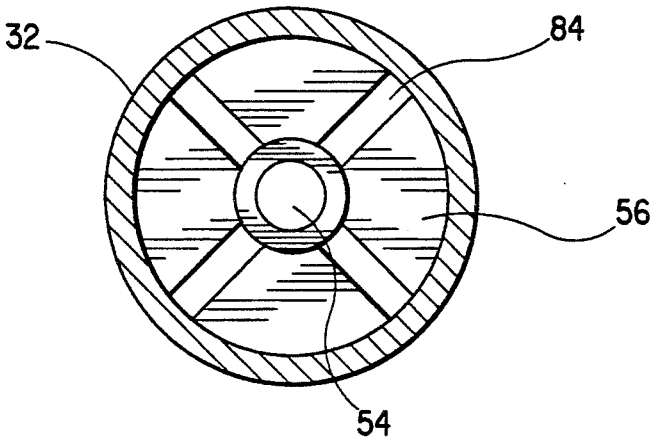
FIG. 6 is a partial cross-sectional view taken along line 6—6 of FIG. 2.

In FIGS. 2, 3 and 6, numeral 84 represents a spider or like member for supporting piping 28 within passage 70 of nozzle assembly 32.

A number of means can be used to apply back pressure against the flow of the nonsolvent stream. For example, such back pressure can be generated by a restriction placed in the discharge line, such as a reduced orifice or a valve attached to the end of diffuser 68. One especially suitable means for obtaining back pressure involves the use of a hollow cylindrical tube having a plurality of curved sheetlike elements extending longitudinally within the tube, as fully described and illustrated in detail in U.S. Pat. No. 3,286,992 to D. D. Avmeniades et al., the disclosure of which is incorporated herein by reference.

USE AND OPERATION

Nonsolvent solution, e.g. water, flows under pressure from reservoir C through pump 10 and pipe 12 to eductor A entering through piping 28. Pressure may be applied against the flow of the nonsolvent stream by means of a back pressure assembly (not shown) to diverge or disperse the stream. The solution of normally crystalline explosive dissolved in solvent entering through inlet passage 72 and injected into mixing chamber 62 by orifice 56 is intimately and rapidly mixed with nonsolvent in mixing chamber 62, especially in throat 64. Mixing and precipitation continue as the combined stream flows through throat 64 to diffuser 68 at which time precipitation of the explosive is substantially complete. The solution of explosive and nonsolvent precipitating agent are usually mixed for about one-half to no more than about 6 milliseconds at which time substantially complete precipitation of the explosive has occurred. The material flows through back pressure assembly to a recovery zone where the ultrafine spheroidal particles of explosive are separated by, for example, filtration, from the liquid and subsequently dried. The liquid solvent-nonsolvent is subsequently separated by distillation or other conventional means.

As noted above, pressure is applied against the flow of the nonsolvent stream. Such pressure, referred to as "back pressure," among other things, causes intimate contact of the streams for rapid precipitation. For example, in eductor type devices, back pressure has the effect of creating a divergent "fanned out" nonsolvent stream. This divergent stream provides intimate and substantially instantaneous mixing of the stream of explosive dissolved in the inert solvent and the stream of the inert nonsolvent. The extent of back pressure applied to the nonsolvent stream in the device will vary somewhat depending upon the design of the mixing apparatus, e.g., eductor, and the dimensions of the apparatus and the pressures of the inert nonsolvent, e.g. water. However, the pressure difference between the motive fluid, i.e. nonsolvent, and back pressure, taking into account the design of the particular apparatus, is usually so regulated that the combined stream will be mixed and the explosive substantially fully precipitated in no more than about 6 milliseconds. Generally, intimate mixing and rapid precipitation occur in about from 0.5 to 6 milliseconds. Preferably, the amount of back pressure applied against the nonsolvent to produce ultrafine, generally spheroidal particles is from about 2–6 pounds per square inch gauge and the nonsolvent stream is preferably pumped at a pressure of about from 80 to 150 pounds per square inch gauge.

The novel product produced by the process of the present invention can be used in the same manner and for the same purpose as other high explosives, however, these products exhibit characteristics not found in explosives made by prior art processes. The explosives can be characterized as containing spheroidal-shaped ultrafine particles. The particles consist of agglomerated crystallites of the explosive. The explosives may contain microholes that may be dispersed throughout the particles.

Representative crystalline high explosives which can be prepared in the form of spheroidal, ultrafine particles include organic nitrates, such as pentaerythritol tetranitrate (PETN), and nitromannite, nitramines such as cyclotrimethylene trinitramine (RDX), cyclotetramethylene tetranitroamine (HMX), tetryl, ethylene dinitramine, and aromatic nitro compounds, such as trinitrotoluene (TNT).

Solvents used in the process are those which dissolve the high explosive, are inert to the explosive, and are miscible with the nonsolvent for the explosive. Representative solvents that can be used are ketones, such as acetone, methyethyl ketone, cyclopentanone, and cyclohexanone; esters such as methyl acetate, ethyl acetate and $\beta$-ethoxy-ethyl acetate; chlorinated aromatic hydrocarbons such as chlorobenzene; nitrated hydrocarbons such as nitrobenzene and nitroethane; nitriles such as acetonitrile; and amides such as dimethyl formamide. Acetone is especially preferred because it is inexpensive, a good solvent for the explosives and is readily miscible with water yet is readily separated by distillation. Sufficient solvent is used to completely dissolve all the explosive to be precipitated as small spheroidal particles containing microvoids.

Preferably the concentration of the explosive in the solvent should be high for economic reasons. In a PETN-acetone system at temperatures of about from 20° C. to 60° C., the PETN preferably will constitute from about 5 to 40% by weight of the solution. In a RDX-acetone system at temperature of about from 20° C. to 60° C., the RDX preferably will constitute from about 4 to 12% by weight of the solution. Generally, the temperature of the explosive-solvent stream is from about 35° C.–60° C.

Any nonsolvent for the explosive which is miscible with the solvent may be employed. Representative nonsolvents that can be used in the process are ethers such as methylethyl ether, diethyl ether, ethylpropyl ether and vinyl ether; alcohols such as methanol, ethanol, isopropanol and isobutanol; aromatic hydrocarbons such as benzene and toluene; and chlorinated aliphatic hydrocarbons such as ethylene dichloride, trichloroethylene, trichloroethane, carbon tetrachloride, and chloroform. The preferred nonsolvent is water, primarily because of its low cost. In general, flow rates of the nonsolvent are from about 1.5 to 20 gallons per minute. The pressure of the nonsolvent entering the mixing chamber generally is of the order of 40 to 500 pounds per square inch gauge.

The following Examples I-III further illustrate the invention:

EXAMPLE I

An eductor assembly was set up as illustrated in FIGS. 1 and 2. Filtered water (50°-75° F.) was pumped through the eductor nozzle at a pressure of about 88 pounds per square inch gauge at a rate of about 6.2 gallons per minute. PETN was dissolved in acetone to form a solution of about 16% PETN by weight and fed into the mixing chamber at a rate of about 0.57 gallons per minute. A back pressure of about 4 pounds per square inch was applied against the flow of the nonsolvent stream issuing out of the nozzle center causing it to diverge and fan out. The separate streams of explosive in solution and of nonsolvent were turbulently mixed so as to obtain nonlaminar flow of the streams. Violent agitation of the stream occurs and subsequently the nonsolvent diluted the solvent and caused precipitation of the explosive particles. The test resulted in average particle size of about 6.7 microns, 75% by weight having a particle size less than 10 microns. This is in contrast to prior art procedures which produce only up to 30% by weight of particles having an average size of less than 10 microns.

EXAMPLE II

The procedure described above in Example I was repeated, except that HMX was substituted for PETN.

Filtered water (50°-75° F.) was pumped through the eductor nozzle at a pressure of about 88 pounds per square inch gauge at a rate of about 6.2 gallons per minute. HMX was dissolved in acetone to form a solution of about 3.7% HMX by weight and fed into the mixing chamber at a rate of about 1.5 gallons per minute. A back pressure of about 4 pounds per square inch was applied against the flow of the nonsolvent stream issuing out of the nozzle center causing it to diverge and fan out. The separate streams of explosive in solution and of nonsolvent were turbulently mixed so as to obtain nonlaminar flow of the streams. Violent agitation of the stream occurs and subsequently the nonsolvent diluted the solvent and caused precipitation of the explosive particles. The test resulted in average particle size of about 3.7 microns, 99.5% by weight having a particle size less than 10 microns.

EXAMPLE III

The procedure described above in Example I was repeated, except that RDX was substituted for PETN.

Filtered water (50°-75° F.) was pumped through the eductor nozzle at a pressure of about 88 pounds per square inch gauge at a rate of about 6.2 gallons per minute. RDX was dissolved in acetone to form a solution of about 8.9% RDX by weight and fed into the mixing chamber at a rate of about 1.5 gallons per minute. A back pressure of about 4 pounds per square inch was applied against the flow of the nonsolvent stream issuing out of the nozzle center causing it to diverge and fan out. The separate streams of explosive in solution and of nonsolvent were turbulently mixed so as to obtain nonlaminar flow of the streams. Violent agitation of the stream occurs and subsequently the nonsolvent diluted the solvent and caused precipitation of the explosive particles. The test resulted in average particle size of about 4.0 microns, 98% by weight having a particle size less than 10 microns.

While this invention has been described as having a preferred design, it is understood that it is capable of further modifications, uses and/or adaptations of the invention following in general the principle of the invention and including such departures from the present disclosure as may come within known or customary practice in the art to which the invention pertains, and as may be applied to the essential features herein set forth, and fall within the scope of the invention or the limits of the appended claims.

What is claimed is:

1. An apparatus for producing ultrafine explosive particles, comprising:
   (a) a first inlet means for injecting a solution of a crystalizable explosive composition;
   (b) a second inlet means coaxial with said first inlet means for injecting a nonsolvent solution for mixing with the explosive;
   (c) said first inlet means injecting the explosive solution downstream of and surrounding said second inlet means;
   (d) nozzle means having first and second ends, said nozzle being adapted for moving the explosive and nonsolvent solutions in generally parallel relationship along the axes of their corresponding inlet means for a substantial distance;
   (e) said first end of said nozzle means coaxial with and in operable communication with said first and second inlet means;
   (f) venturi means having first and second ends;
   (g) said second end of said nozzle means communicating with and projecting into said first end of said venturi means; and
   (h) explosive particle collection means connected with said second end of said venturi means.

2. The apparatus of claim 1, further comprising an auxiliary inlet means coaxial with and surrounding said first and second inlet means.

3. The apparatus of claim 2, wherein said nozzle means include first and second continuous orifices at the second end thereof.

4. The apparatus of claim 3, wherein the diameter of said second orifice is about one-half the diameter of said first orifice.

5. The apparatus of claim 3, wherein:
   (a) said auxiliary inlet means including a third orifice communicating with said venturi means; and
   (b) the diameter of said second orifice is about two-fifths the diameter of said third orifice.

6. The apparatus of claim 5, wherein said venturi means including, in succession, a mixing chamber having a convergence zone and a throat portion, and a diffusing means.

7. The apparatus of claim 5, wherein:
   (a) said auxiliary inlet means including a plurality of radially extending inlet passages opening into a generally circular common zone; and
   (b) said common zone communicating with said third orifice.

8. An apparatus for producing ultrafine explosive particles, comprising:

(a) a first inlet means for injecting a solution of a crystalizable explosive composition;

(b) a second inlet means coaxial and concentric with said first inlet means for injecting a nonsolvent solution for mixing with the explosive solution;

(c) said first inlet means injecting the explosive solution downstream of and sorrounding said second inlet means;

(d) nozzle means having first and second ends;

(e) said first end of said nozzle means coaxial with and in operable communication with said first and second inlet means;

(f) venturi means having first and second ends;

(g) said second end of said nozzle means communicating with and projecting into said first end of said venturi means;

(h) explosive particle collection means connected with said second end of said venturi means;

(i) the explosive and nonsolvent solutions movable in generally parallel relationship along the axes of their corresponding inlet means for a substantial distance toward said venturi means;

(j) an auxiliary inlet means for injecting said nonsolvent into said venturi means;

(k) said venturi means including, in succession, a mixing chamber having a convergence zone and a throat portion, and a diffusing means.

9. The apparatus of claim 8, wherein said nozzle means include first, second, and third continuous orifices at the second end thereof.

10. The apparatus of claim 9, wherein the diameter of said second orifice is about one-half the diameter of said first orifice.

11. The apparatus of claim 9, wherein the diameter of said second orifice is about two-fifths the diameter of said third orifice.

12. The apparatus of claim 8, wherein said auxiliary inlet means includes a plurality of radially extending passages opening into a generally circular common zone communicating with said venturi means via said third orifice.

13. A method for producing ultrafine explosive particles comprising the steps of injecting a solution of a crystalizable explosive composition in an inert solvent and a nonsolvent solution into a nozzle in the form of two generally parallel but isolated concentric streams, converging said streams in a mixing zone under turbulent conditions to entrap said solution of crystalizable explosive composition in droplets of nonsolvent to rapidly precipitate said explosive composition in the form of spheroidal particles, and thereafter recovering said spheroidal particles from the solvent and nonsolvent materials.

14. The process of claim 13 wherein a plurality of streams of nonsolvent are combined to form a second parallel but isolated concentric stream which is converged in the mixing zone with said other two streams.

15. The process of claim 13 wherein said crystalizable explosive composition is selected from the group consisting of pentaerythritol tetranitrate, nitromannite cyclotrimethylene trinitramine, trinitrotoluene, and cyclotetramethylene tetranitramine.

16. The process of claim 13 wherein said solvent is acetone and said nonsolvent is water.

* * * * *